United States Patent [19]

Eriksen

[11] Patent Number: 4,772,017

[45] Date of Patent: Sep. 20, 1988

[54] PROJECTOR FOR PROJECTING A TENNIS BALL

[76] Inventor: Willy M. Eriksen, 9710 - 9th Ave. NW., Seattle, Wash. 98117

[21] Appl. No.: 76,368

[22] Filed: Sep. 17, 1979

[51] Int. Cl.[4] ..... A63B 69/40

[52] U.S. Cl. ..... 273/29 A; 124/78; 124/1

[58] Field of Search ..... 273/29 R, 29 B, 26 D, 273/30; 124/1, 6, 10, 78, 77

[56] References Cited

U.S. PATENT DOCUMENTS

| | | | |
|---|---|---|---|
| 1,211,738 | 1/1917 | Marty | 124/6 |
| 2,705,945 | 4/1955 | Cavalier | 124/6 |
| 2,918,915 | 12/1959 | Doeg | 124/78 |
| 2,925,811 | 2/1960 | Cook | 124/6 |
| 3,713,658 | 1/1973 | Cook | 124/6 |
| 3,815,907 | 6/1974 | Cook | 273/30 |
| 4,025,071 | 5/1977 | Hodges | 124/78 |
| 4,080,950 | 3/1978 | Paulson | 124/1 |
| 4,086,903 | 5/1978 | Scott | 124/78 |
| 4,197,827 | 3/1980 | Smith | 273/26 D |

FOREIGN PATENT DOCUMENTS

| | | | |
|---|---|---|---|
| 2438339 | 2/1976 | Fed. Rep. of Germany | 273/29 A |

*Primary Examiner*—Richard C. Pinkham
*Assistant Examiner*—T. Brown
*Attorney, Agent, or Firm*—T. W. Secrest

[57] ABSTRACT

A projector for projecting a tennis ball through the air. The projector has a housing containing a loading opening and two spaced recesses. A wheel with a roughened periphery is rotatably mounted in each recess. At least one of the wheels is motor-driven. The wheels are spaced from one another sufficiently that a tennis ball directed between them will be gripped and ejected from the housing toward a tennis player. The distance between the two wheels may be adjusted. A backstop is provided to stop a tennis ball driven by the tennis player. The backstop directs the stopped ball to the loading opening of the projector for reprojection to the player.

36 Claims, 13 Drawing Sheets

PROJECTOR FOR PROJECTING A TENNIS BALL

A BRIEF DESCRIPTION OF THE INVENTION

This invention ejects a spherical object such as a tennis ball. The ejected tennis ball can be hit by a tennis racket in the hand of a person desiring to improve his or her game of tennis.

The invention, in one form, comprises a housing having a recess. There is an opening to the recess allowing a tennis ball to be introduced to the recess and an opening allowing a tennis ball to be ejected from the recess. In the recess there is a rotating curved surface. The tennis ball, upon entering the recess, is moved by the rotating curved surface. The rotating curved surface ejects the tennis ball through the exit opening.

In another species there may be two recesses in the housing. The two recesses connect with each other. The recess connecting with the openings may position a rotating curved surface. Then, in the other recess there may be an idler curved surface or an idling curved surface. Again, the tennis ball is given movement by the rotating curved surface. The tennis ball moves between the two curved surfaces in the two recesses and is ejected through the exit opening.

In a third species of the invention there are two recesses. The two recesses connect with each other. In each of the recesses there is a rotating curved surface. The two rotating curved surfaces rotate in opposite directions. The tennis ball can enter in one opening leading to the first recess and is given movement by the first rotating curved surface. Then, the tennis ball, while in contact with the first rotating curved surface, comes in contact with the second rotating curved surface and is given additional velocity and momentum and is ejected through the exit opening connecting with the first recess.

THE DRAWINGS

Figure 6:
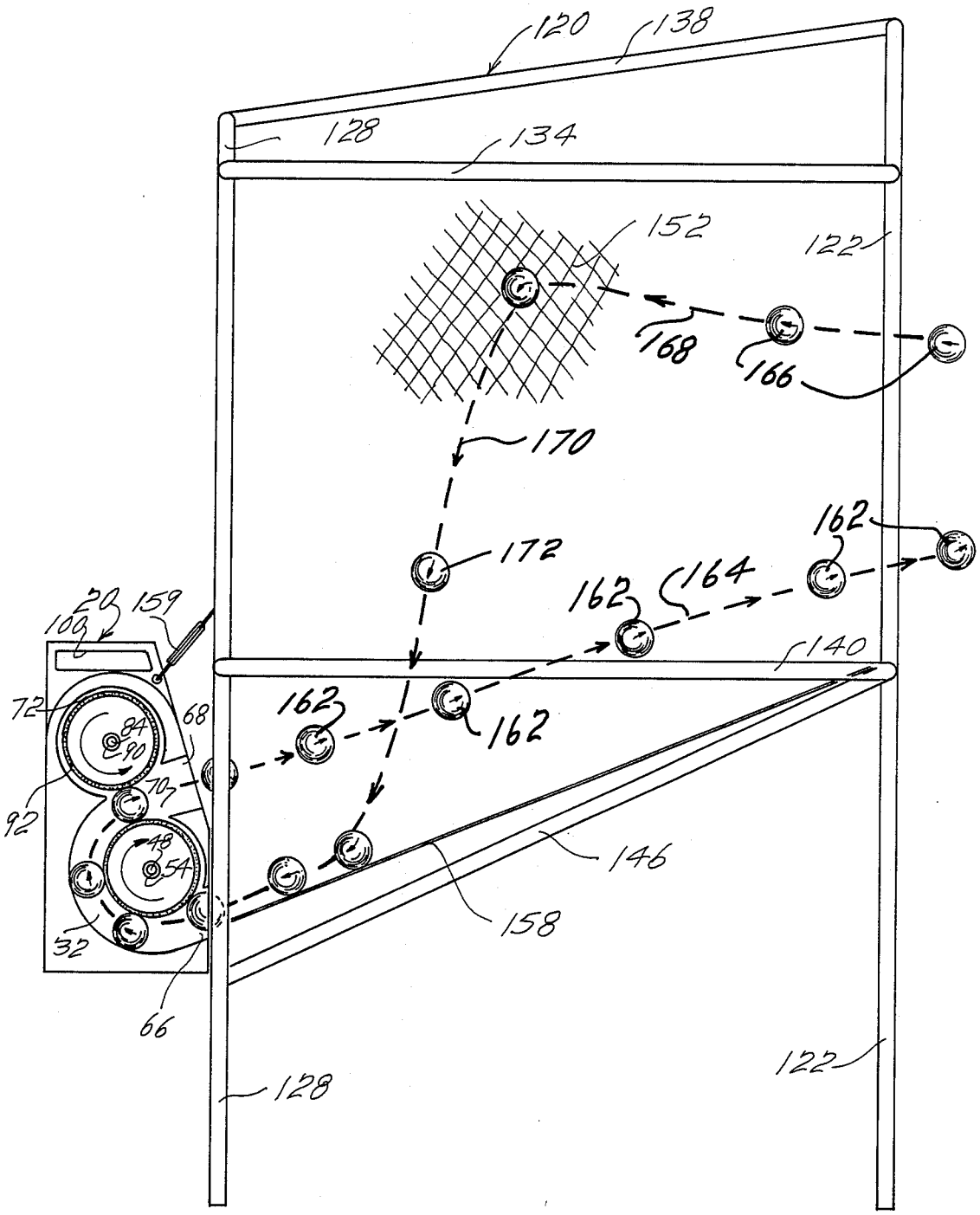
Figure 7:
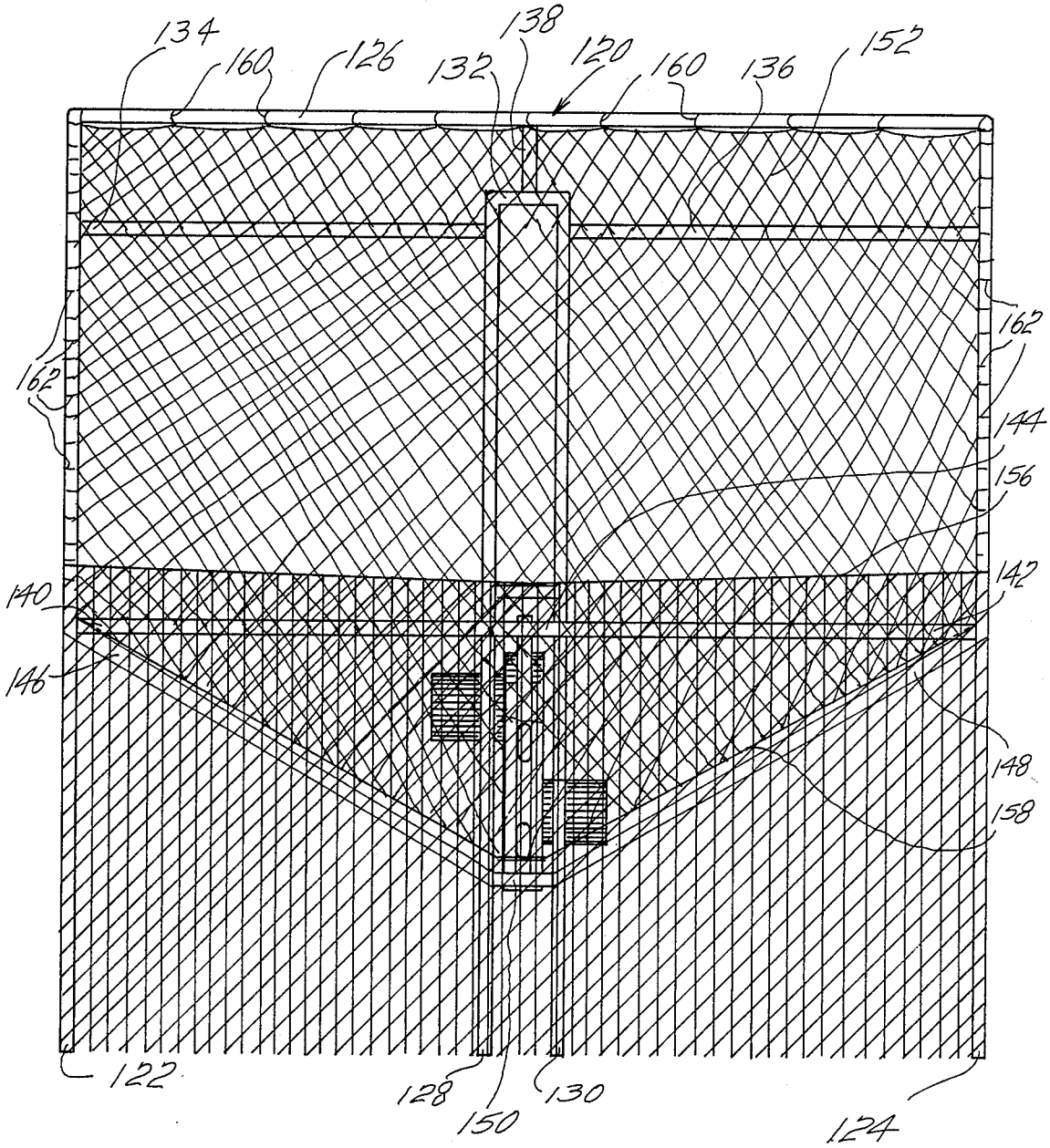
Figure 8:
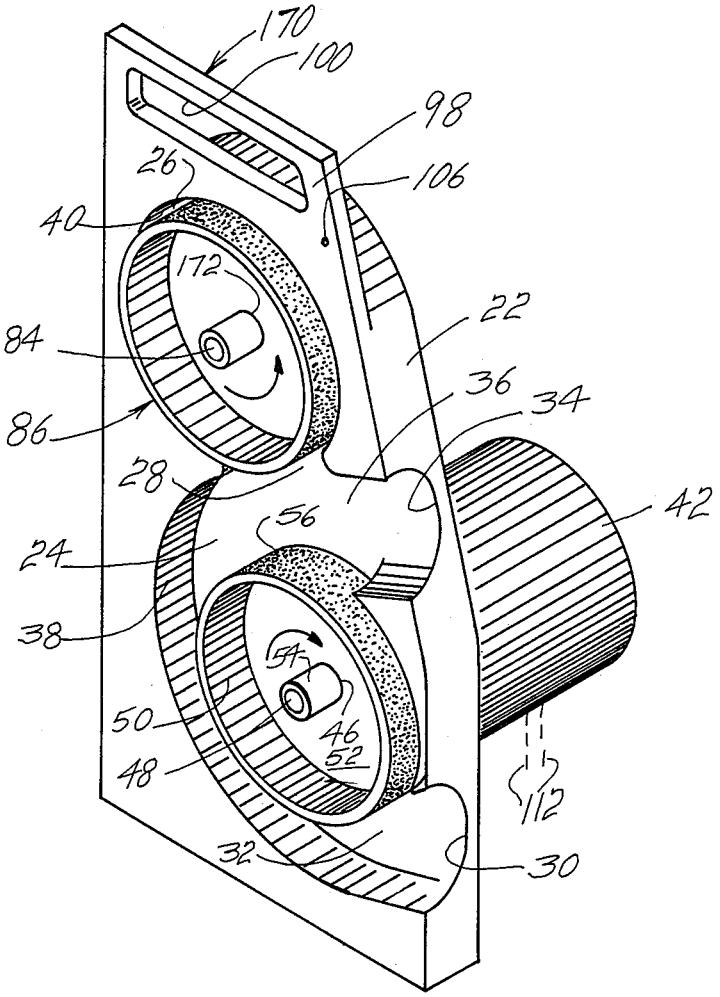
Figure 9:
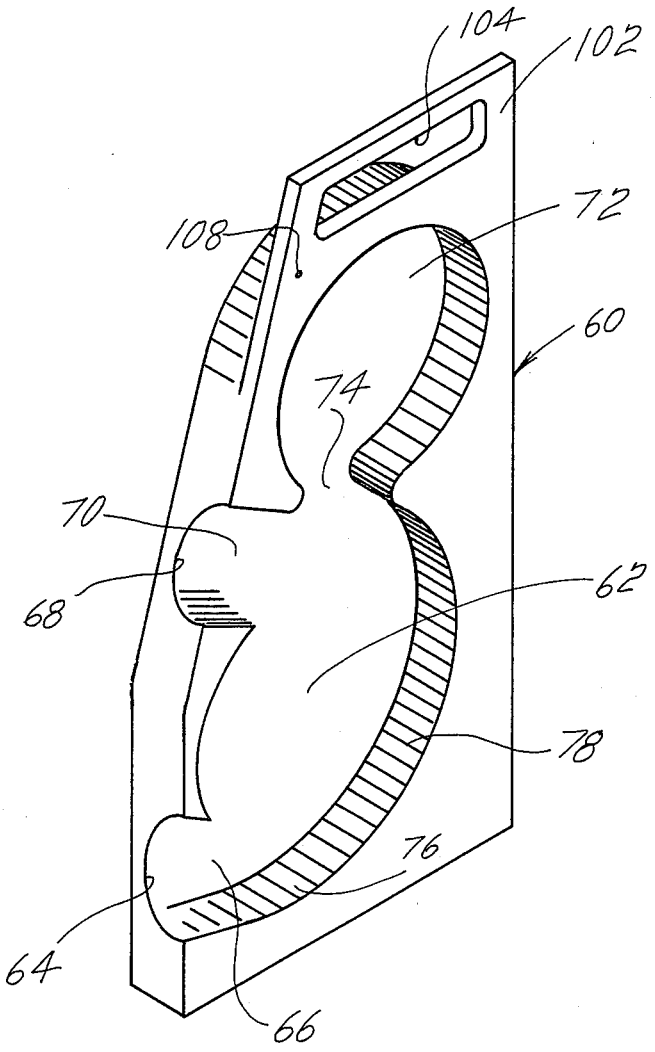
Figure 10:
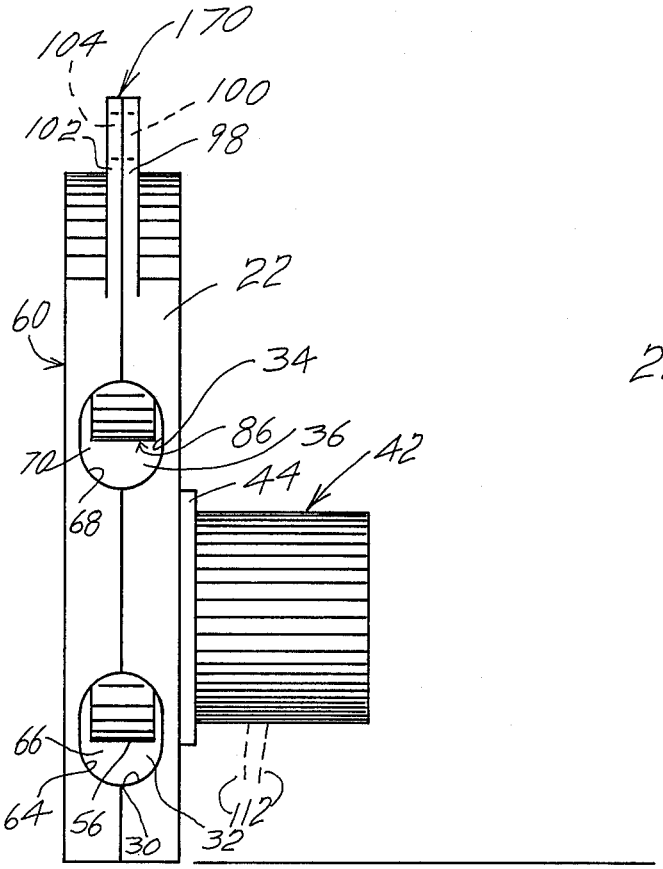
Figure 11:
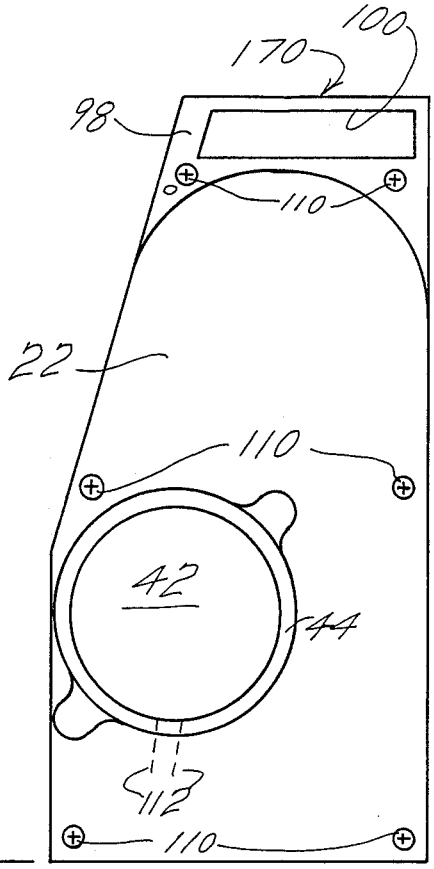
Figure 12:
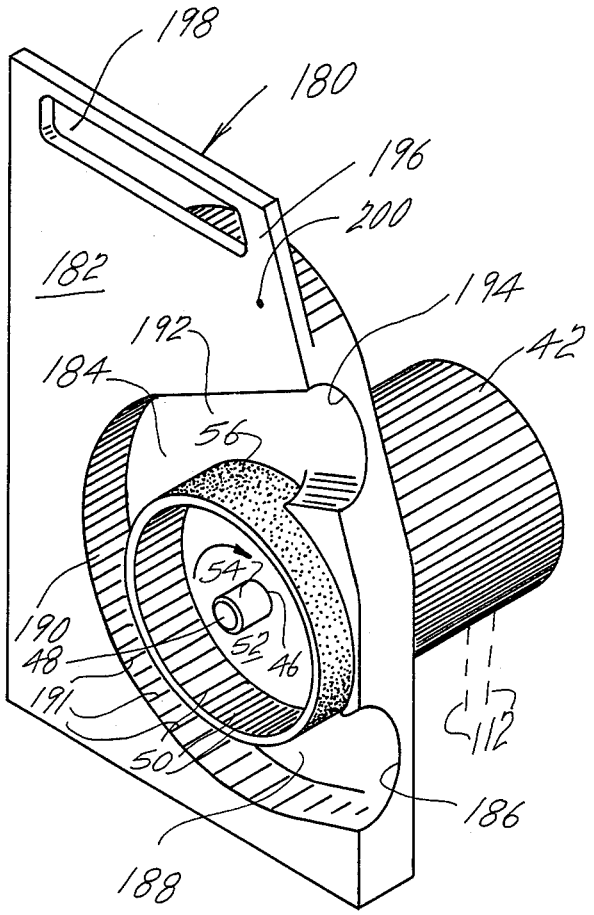
Figure 13:
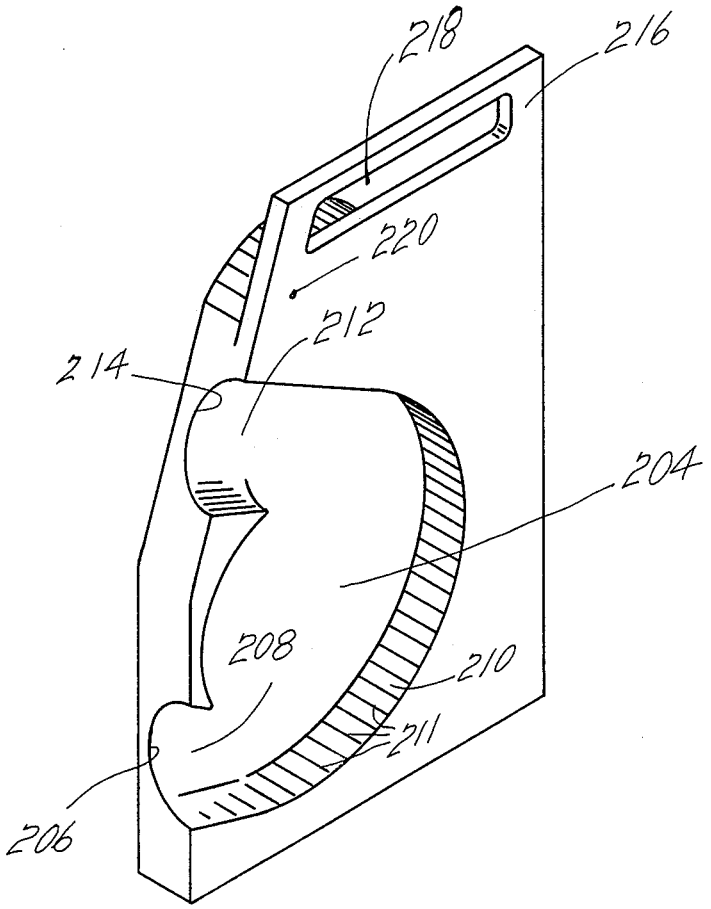
Figure 14:
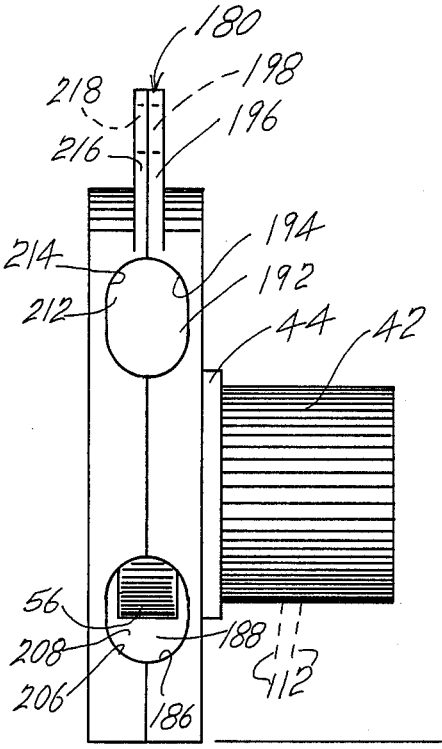
Figure 15:
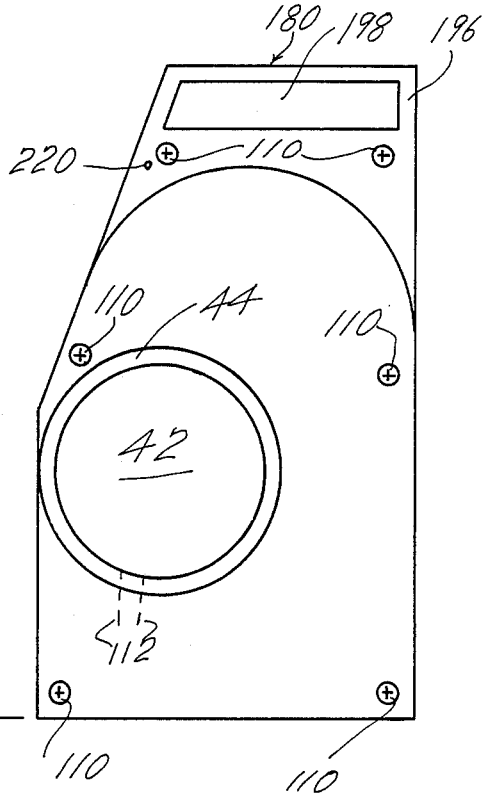
Figure 16:
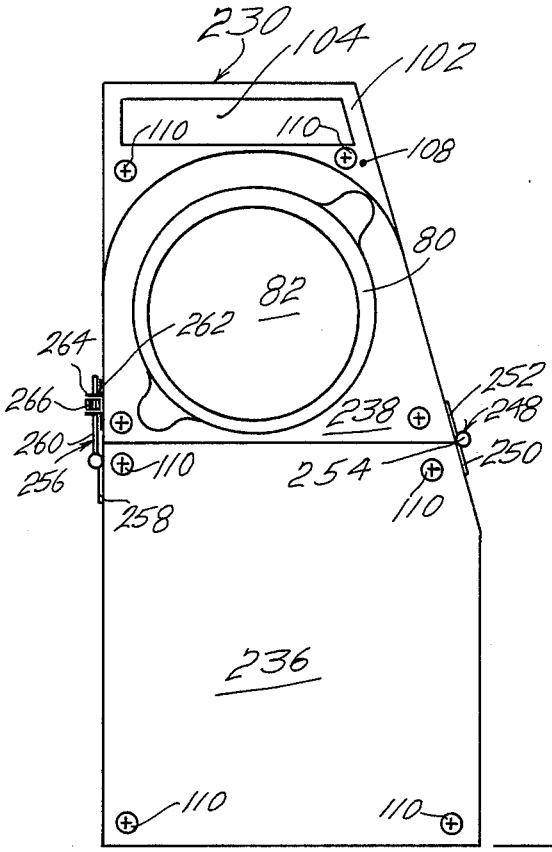
Figure 17:
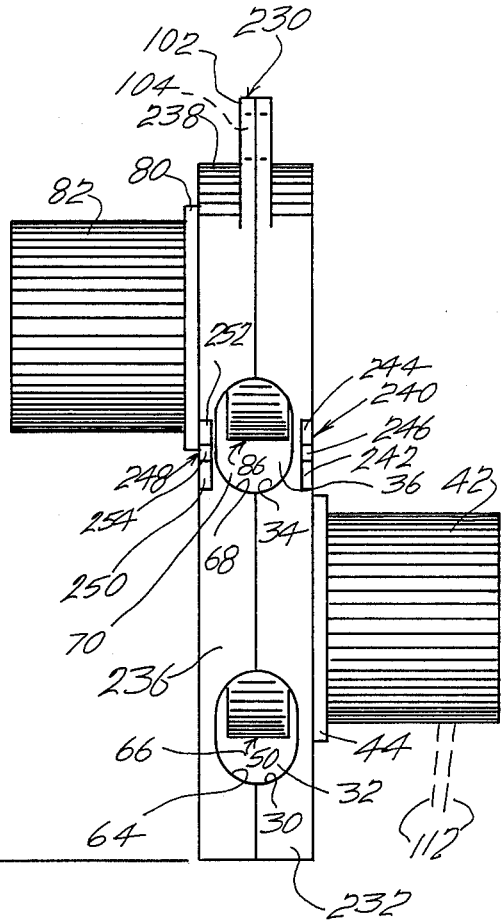

FIG. 6 is a side elevational view illustrating the combination of the projector and the backstop and illustrates the ejection of tennis balls from the projector, the return of the tennis balls to the backstop so that the backstop interrupts the flight of the tennis balls and then the directing of the tennis balls to a certain location which is near the projector so that the projector can receive the tennis balls and, subsequently, eject the tennis balls;

FIG. 7 is a front elevational view illustrating the backstop and the projector;

FIG. 8 is a perspective view looking at the interior of another species of the projector and illustrates a first rotatable curved surface and a driving means therefore and a second rotatable curved surface which may be an idler curved surface or an idling curved surface;

FIG. 9 is a perspective view illustrating another half of the housing of the projector to connect with the housing of FIG. 8;

FIG. 10 is a front elevational view of the second species of the invention and illustrates the two rotatable curved surfaces and the driving means for the lower curved surface;

FIG. 11 is a side elevational view of the projector of FIG. 10;

FIG. 12 is a perspective view looking at the interior of one half of the housing of a third species of the invention and illustrates a rotatable curved surface and the driving means therefor;

FIG. 13 is a perspective view looking at the interior of the other half of the housing which connects with the housing of FIG. 12;

FIG. 14 is a front elevational view of the species of the invention of FIGS. 12 and 13;

FIG. 15 is a side elevational view of the species of the invention of FIG. 14;

FIG. 16 is a side elevational view of another species of the invention having two rotating curved surfaces and a means for varying the distance between said two rotating curved surfaces; and, FIG. 17 is a front elevational view of the species of the invention of FIG. 16.

THE SPECIFIC DESCRIPTION OF THE INVENTION

This invention is directed to ejecting and propelling a tennis ball. The tennis ball flies through the air. A person interested in practicing tennis can hit the tennis ball as it flies through the air or let the tennis ball bounce and then can hit the tennis ball. The projector is portable and can be easily carried by a person practicing tennis. Further, the projector is small and compact and can be set up in a room or in a basement. It is inexpensive to manufacture as there are few moving parts. In one species there is one rotating curved surface and in another species there are two rotating curved surfaces. Also, there can be used with the projector a portable backstop which feeds tennis balls to the projector and the projector can eject the tennis balls to a person practicing tennis. The person practicing tennis can hit the tennis balls towards the backstop which, to repeat, feeds the tennis balls to the projector. In this manner the person practicing tennis improves the gam of tennis and also engages in mild exercise in a small area such as a room or a basement or a garage or a backyard patio. Or, a professional tennis instructor may use the invention as a teaching aid.

In FIGS. 1–7 there is illustrated a first species of the projector 20.

The first half of the projector 20 comprises a housing 22. The housing 22 is essentially a thick piece of metal having a lower, generally, circular recess 24 and an upper, generally, circular recess 26.

The two recesses 24 and 26 are connected by a passageway 28.

There is a lower opening 30 connecting with a passageway 32. The passageway 32 connects with the recess 24. Also, there is an upper opening 34 which connects with a passageway 36. The passageway 36 connects with the recess 24. Also, the passageway 36 can be considered to connect with the passageway 28.

The recess 24 has a curved wall 38. Also, the recess 26 has a curved wall 40.

There is a lower motor 42 mounted on a mounting bracket 44. There is a passageway or opening 46 in the housing 22. This opening 46 opens into the lower, generally, circular recess 24.

The mounting bracket 44 for the motor 42 is positioned on the outside of the housing 22. A shaft 48 of the motor 42 projects through the opening 46 in hub 54 and into the recess 24.

There is a cylinder 50. The cylinder 50 has a circular base 52, a hub 54 which co-fits with the shaft 48 and a circular rim 56. The surface of the circular rim 56 may be a roughened surface 58.

Figure 3:
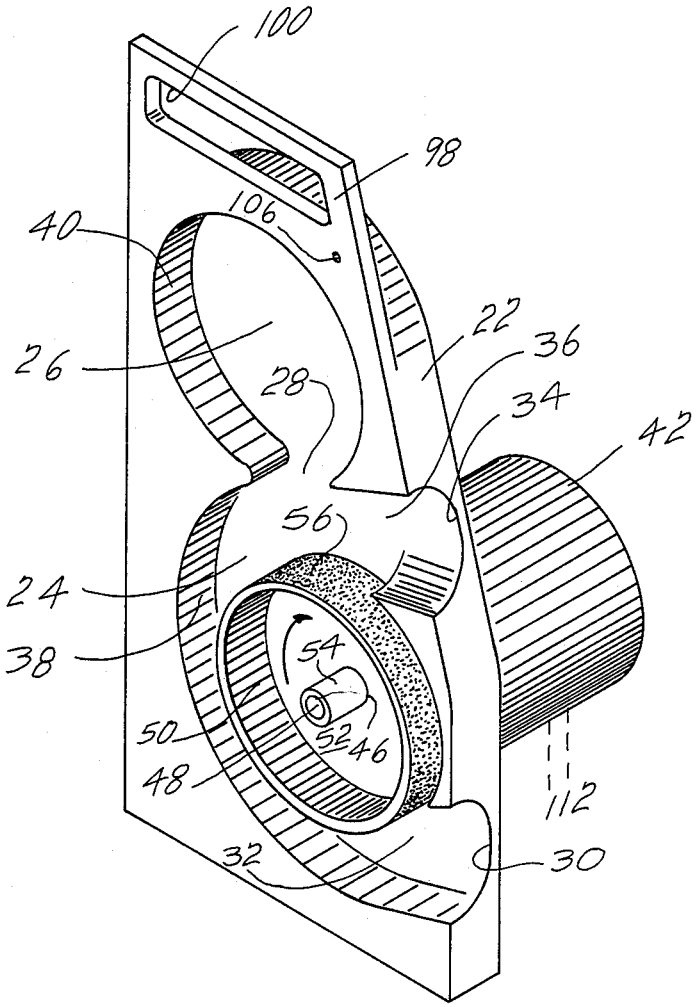
FIG. 3 is a perspective view looking at the interior of one half of the housing and showing the lower rotatable curved surface and the driving means therefor.

In FIG. 3 it is seen that the cylinder 50 rotates in a clockwise direction. The electric motor 42 can be activated and the cylinder 50 will rotate in a clockwise direction.

The curved wall 38 may be roughened or serrated.

Figure 4:
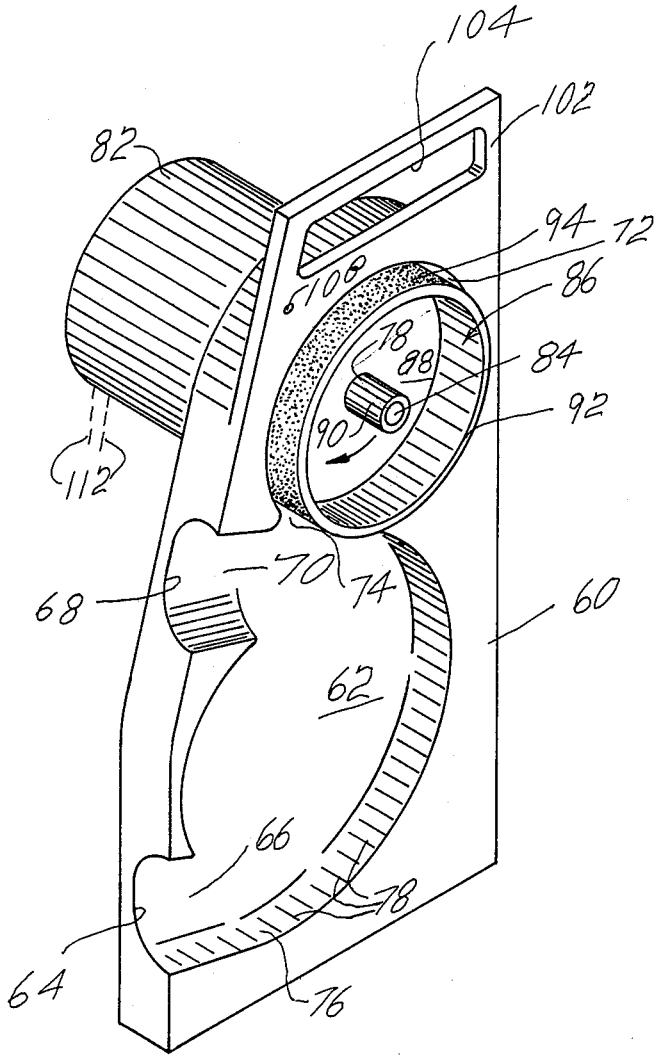
FIG. 4 is a perspective view looking at the interior of the other half of the housing and shows the upper rotatable curved surface and the driving means therefore.
Figure 5:
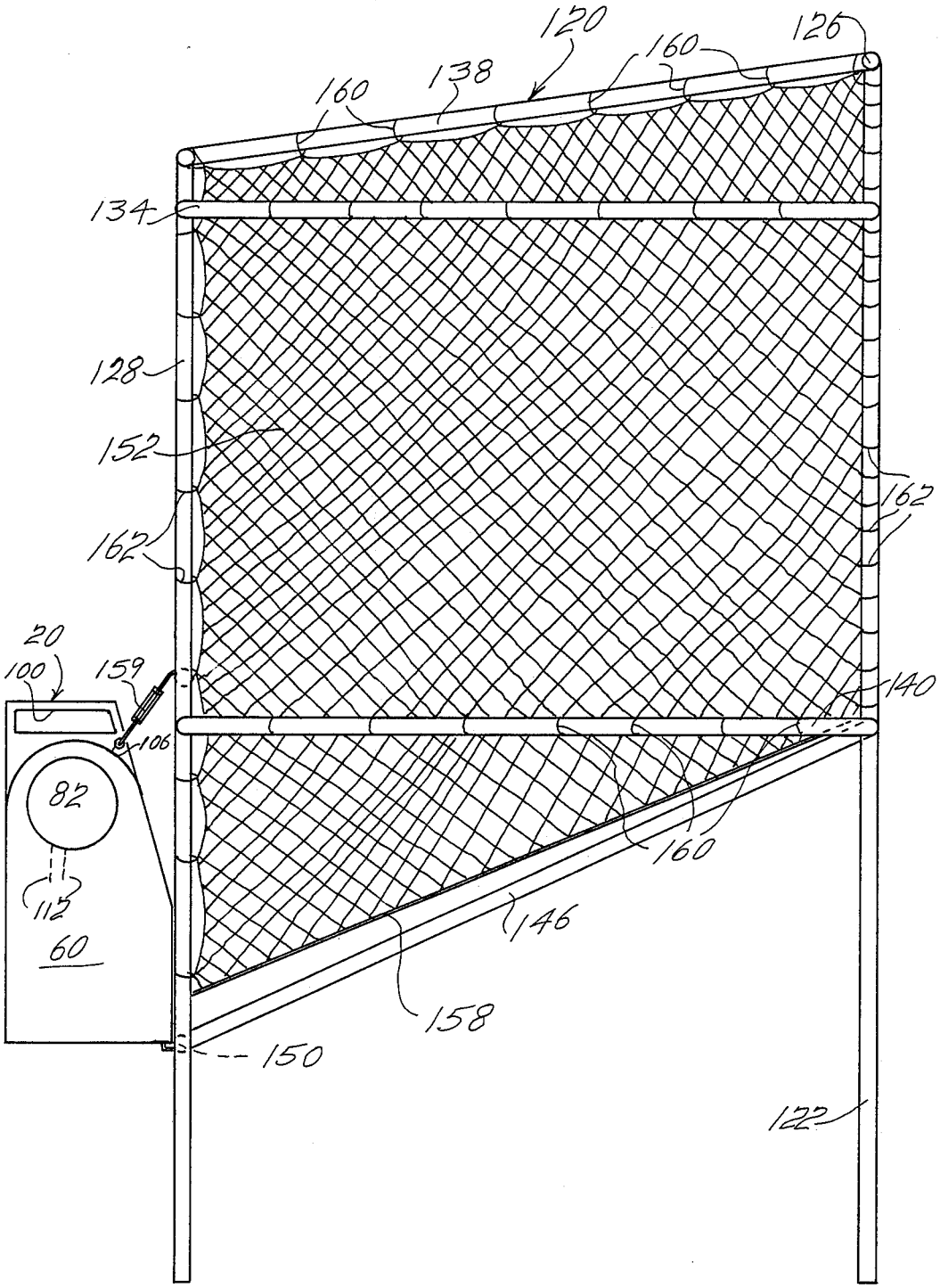
FIG. 5 is a side elevational view illustrating the combination of a backstop and a projector attached to the backstop by a turnbuckle.

In FIG. 4 there is illustrated the second half 60 of the housing.

In the lower part of the second half 60 there is a lower, generally, circular recess 62. There is a lower opening 64 connecting with a lower passageway 66. The lower passageway 66 connects with the circular recess 62.

There is an upper opening 68 which connects with the upper passageway 70. The upper passageway 70 connects with the recess 62. The recess 62 is aligned with the recess 24 and is adapted to receive the cylinder 50.

There is an upper, generally, circular recess 72. There is a passageway 74 between the recess 62 and the recess 72.

The recess 62 has a wall 76. The wall 76 may be roughened or serrated at 78.

In the upper part of the second half 60 and at, substantially, the center of the recess 72, there is an opening 78.

Figure 2:
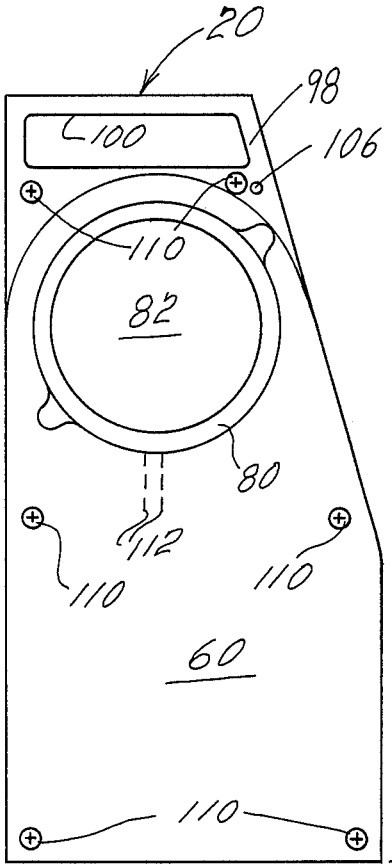
FIG. 2 is a side elevational view of the projector.
Figure 1:
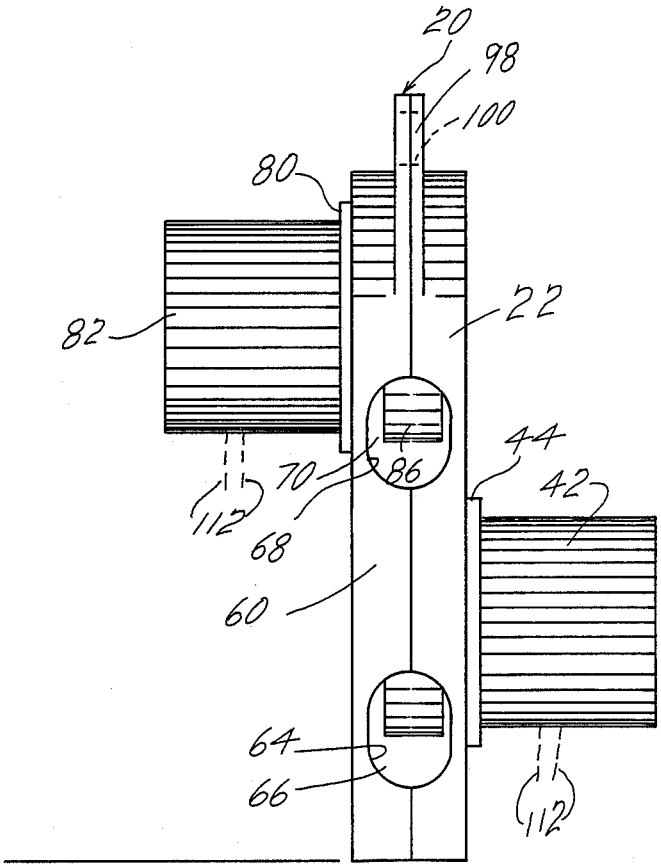
FIG. 1 is a front elevational view of one species of the invention and shows a projector for ejecting a, substantially, spherical object and which projector has two rotating curved surfaces and means for rotating each of these two rotatable curved surfaces.

In FIG. 1 it is seen that there is a mounting bracket 80 for an electric motor 82.

The electric motor 82 has a shaft 84. The shaft 84 projects through the passageway 79 in hub 90 and into the recess 72.

There is a cylinder 86 having a base 88. The cylinder 86 has a hub 90 which co-fits with the shaft 84. Also, the cylinder 86 has a circular rim 92. The external surface of the circular rim 92 may be roughened as illustrated in 94.

In FIG. 4 it is seen that the cylinder 86 rotates in a clockwise direction.

As, previously, stated, in FIG. 3 it is seen that the cylinder 50 rotates in a clockwise direction and in FIG. 4 it is seen that the cylinder 86 rotates in a clockwise direction. The reader is not to be confused by this terminology. The cylinder 50 rotates so as to allow a tennis ball to enter the opening 30 and pass through the passageway 32. Then, the tennis ball is moved by the rotating cylinder 50 between the circular rim 56 and the curved wall 38. Now, the cylinder 86 rotates in the opposite direction to the cylinder 50. The circular rim 92 of the cylinder 86 contacts the tennis ball. Since the cylinder 50 and the cylinder 86 rotate in opposite directions the tennis ball is directed to the passageway 70 and through the upper opening 68 so as to be ejected from the projector 20. The cylinders 50 and 86 rotate in opposite directions but cooperate to move the tennis ball through the passageway 70.

The opening 46 and the opening 64 are aligned. Likewise, the passageway 32 and the passageway 66 are aligned. The recess 24 and the recess 62 are aligned. The passageway 28 and the passageway 70 are aligned. The upper opening 34 and the upper opening 68 are aligned. The recess 26 and the recess 72 are aligned. The passageway 28 and the passageway 70 are aligned.

The tennis ball can enter the lower circular recess at 24 and 62 by means of the lower opening 30 and 64 and also the passageway 32 and 66. Then, the tennis ball is moved by the cylinder 60 so as to move between the cylinder 60 and the curved walls 38 and 76. Then, the cylinders 50 and 86, rotating in opposite directions, move the tennis ball through the passageways 36 and 70 and out through the upper openings 34 and 68. In other words, the tennis ball is ejected from the projector 20 because of the energy and momentum imparted to it by the two rotating cylinders 50 adn 86.

The first half 22 of the housing has an extended upper frame 98 with a passageway 100. The second half 60 of the housing has an extended upper frame 102 and a passageway 104. The passageways 100 and 104 are aligned. It is seen that a person can use the passageways 100 and 104 to lift and carry the projector 20.

Also, in the extended frame 98 there is a passageway 106 and in the extended frame 102 there is a passageway 108. The passageways 106 and 108 are aligned. A turnbuckle 159 can be passed through the passageways 106 and 108 to position the projector 20 to a backstop 120.

The first half 22 of the housing and the second half 60 of the housing can be fastened together by means of tack welding or bolts and nuts 110 or metal screw and the like to form the projector 20.

The motors 42 and 82 may be electric motors having electric wires 112. The electric wires 112 can be connected to a suitable source of electricity. Or, the motors 42 and 82 can be small internal combustion engines such as gasoline engines or engines which run on liquified petroleum gas.

In conjunction with the projector 20 there is the backstop 120. The backstop 120 comprises a frame having a left front upright support 124 and an upper front rail 126. Then, there are a left rear center support 128, a right rear center support 130 and a top rear center rail 132.

There is an upper left rear rail 134 which extends from the left front upright support 122 to the left rear center support 128. There is an upper right rear rail 136 which extends from the right front upright support 124 to the right rear center support 130. There is a top center rail 138 which extends from the upper front rail 126 to the top center rear rail 132

Also, there is a center left rear rail 140 which connects with the central part of the left front upright support 122 and the central part of the left rear center support 128. There is a center right rear rail 142 which connects with the central part of the right front upright support 124 and the central part of the right rear center support 130. Also, there is a central rear rail 144 which connects the central part of the left rear support 128 with the central part of the right rear support 130.

There is a left brace 146 which connects with the central part of the center left rail 140 and the lower part of the left rear center support 128. There is a right brace 148 which connects with the central part of the right front upright support 124 and the lower part of the right rear center support 130. There is a rear lower central brace 150 which connects with the lower part of the left rear center support 128 and the right rear center support 130.

From the foregoing description it is seen that the backstop 120 provides a wide, open front which, upon going backwardly, tapers inwardly.

The backstop 120 must have some means to interrupt the flight of the tennis ball. It is possible to have a plywood top and sides or sheet metal top and sides. One of the desirable means of interrupting the flight of the tennis ball is by means of a net. Therefore, there is provided a net 152 extending from the top center rail 138 to the upper right rear rail 136. Also, this net extends from the left.front upright support 122, to the left rear center support 128 and the right rear center support 130 to the right front upright support 124. This provides a net which extends from the top of the backstop and also the sides and the rear. There is provided another net which extends from the central part of the left front upright support 122 and the right front upright support 124 and to the lower middle part of the left rear center support 128 and the right rear center support 130. It is seen that this net 154 has a forward upward part 156 and a lower part 158 which slopes downwardly and rearwardly toward the rear lower central brace 150. It is seen that the part of the net 154 actually functions as a funnel to direct a tennis ball, after the flight of the tennis ball has been interrupted, to the lower rear central part of the backstop 120.

On the left rear center support 128 and the right rear center support 130 there may be positioned a string 160. The string 160 can be attached to the supports 128 and 130 and also to the passageways 106 and 108 of the projector 20. In other words the supports 128 and 130 support the projector 20. The lower openings 30 and 64 of the projector 20 are juxtapositioned to the rear lower central part 150 of the net 154 so as to accept a tennis ball.

In FIG. 6 it is seen that the projector 20 ejects tennis ball 162 through the upper openings 34 and 68 of the projector 20. The tennis ball 162 follows a flight pattern 164. The tennis ball 162 flies through the open front part of the backstop 120. A person with a tennis racket can hit the tennis ball 162 towards the backstop 120. The reference numeral 166 is given to the tennis ball after it has been hit by a person with a tennis racket. The flight path of the tennis ball is given reference numeral 168.

The tennis ball 166 flies through the open front of the backstop 120 and hits the net 152, either the back or the side and falls in flight pattern 170 towards the net 154. At this time the reference number 172 is given to the tennis ball. Again, the tennis ball falls towards the net 154. The tennis ball rolls or falls to the bottom 158 of the net 154 and rolls towards the openings 30 and 64 of the projector 20. The tennis ball enters these openings and contacts the cylinder 50 and is, once again, ejected from the projector 20 as tennis ball 162 and in flight pattern 164.

In this manner it can be seen that a person wanting to practice hitting a tennis ball can set up the backstop in a room, a garage, a basement or out in the open, and can attach the projector 20 to the backstop 120 and start hitting the tennis balls as the tennis balls are ejected from the projected 20. The turnbuckle 159 connects together the projector and the backstop 120. By adjusting the turnbuckle 159 it is possible to vary the angle of the discharge passageway 34 with respect to the backstop 120. The angle of the discharge passageway is important in determining the trajectory of the ejected tennis ball and the distance the tennis ball will travel without bouncing. With this variation in the angle the person practicing tennis will see a tennis ball at different positions and different paths of travel.

The projector 20 is small, light in weight and easily transported. The backstop 120 can be light in weight and of material such as wood or metal for the frame and a net. The backstop 120 can be disassembled and readily stored. Then, when a person desires to practice hitting the tennis ball the backstop 120 can be assembled and the person can hit the tennis ball.

The net 152 can be tied to the upper front rail 126, the upper right rear rail 136, the left front upright support 122 and the right front upright support 124 by means of strings or rope or wire 160.

Similarly, the net 154 can be tied at 162 to the left front upright support 122 and the right front upright support 124 as well as the left rear center support 128 and the right rear center support 130.

The lower rear part of the net 152 is open so as to allow the tennis ball 172 to enter the openings 30 and 64 of the projector 20 and also leave the openings 34 and 68 of the projector 20.

In FIGS. 8, 9, 10 and 11 there is illustrated the projector 170. The projector 170 comprises the first half 22 of the housing and the second half 60 of the housing.

Instead of two motors 42 and 82 there is one motor 42, the lower motor. The lower motor 42 drives a cylinder 50 as previously explained with respect to projector 20.

In the upper recess 26 of the first half 22 of the housing there is positioned a cylinder 86 having a base 88 and a hub 90. The hub 90 is mounted on a shaft 84 which connects with the first half 22 of the housing. The cylinder 86 is free to rotate on the shaft 84 which is attached to the first half 22 of the housing. The cylinder 86 may be considered to be considered to be an idler cylinder or an idling cylinder. The outer surface of the cylinder 86 may be roughened so as to have better grip or hold on a tennis ball.

Again, the motor 42 may be an electric motor having electric wires 112 and connecting with a suitable source of electricity. Or the motor 42 may be a gasoline or liquified petroleum gas internal combustion engine.

The tennis ball will enter through the lower opening 30 and pass through the passageway 32. The rotating cylinder 50 will move the tennis ball through the passageway 32 and along the curved wall 38. Then, the tennis ball will be positioned between the exterior surface of the cylinder 50 and the exterior surface of the cylinder 86 and be propelled through the upper passageway 28 and be ejected through the upper opening 32. As can be seen the cylinder 86 is an idler cylinder under these circumstances and will rotate along with the movement of the tennis ball and the rotation of the cylinder 50 to compress the tennis ball to impart increased velocity and momentum to the tennis ball.

In FIGS. 12, 13, 14 and 15 there is illustrated a projector 80. The projector 180 has the first half 182 of a housing. There is a generally circular recess 184. There is a lower opening 186 leading into a lower passageway 188 which connects with the generally circular recess 184. The circular recess 184 has a curved wall 190 which may be roughened or have striations 191. The generally circular recess 184 connects with an upper passageway 198 which leads into an upper opening 194.

The first half 182 of the housing has an extended frame 196. In the upper part of the extended frame 196 there is a passageway 198 and also a passageway 200.

The projector 180 has a second half 202. In the housing there is a generally circular recess 204. There is a lower opening 206 leading to a lower passageway 208. The generally circular recess 204 has a curved wall 210. The curved wall 210 may have striations 211 or may have a roughened surface.

The generally circular recess 204 connects with an upper passageway 212 which connects with an upper opening 214.

The second half 202 of the housing has an extended frame 216. In the upper part of the extended frame 216 there is a passageway 218 and a passageway 220.

In the first half 182 of the housing and also in the generally circular recess 184 there is positioned the cylinder 50. The cylinder 50 has a base 52 and a hub 54. In the wall of the first half 182 of the housing there can be an opening 46.

On the outer part of the first half 182 of the housing there is a mounting bracket 44. Motor 42 is mounted on said mounting bracket. The motor has a shaft 48. The hub 54 of the cylinder 50 is mounted on said shaft. In FIG. 12 it is seen that cylinder 50 rotates in a clockwise direction.

The motor 42 may be an electric motor having electrical wires 112 for connecting with a suitable source of electricity. Or, the motor 42 may be an internal combustion engine which can operate on gasoline or liquified petroleum gas or the like.

In operation the first half 182 of the housing and the second half 202 of the housing are united either by tack welding, bolts and nuts or metal screws with the cylinder 50 in the generally circular recess 184 and also in the generally circular recess 204.

A tennis ball can enter into the lower openings 186 and 206 to enter into the lower passageways 188 and 208. The outer surface of the cylinder 50 may be roughened. The space between the outer surface of the cylinder 50 and the curved walls 190 and 210 form a passageway. The tennis ball contacts the outer surface of the cylinder 50 and is caused to move in the passageway between the outer surface of the cylinder 50 and the curved walls 190 and 210. Then, the tennis ball enters the upper passageways 200 and 212 and is ejected through the openings 194 and 214 so as to assume a flight in air. Again, a turnbuckle 159 may connect together the backstop 120 and the projector 180.

In FIGS. 16 and 17 there is illustrated another species of the invention. This species comprises a projector 230. The projector 230 is similar to the projector 20. The distinguishing feature of the projector 230 over the projector 20 is that it is possible to vary the distance between the rotating cylinder 50 and the rotating cylinder 86. As is recalled the distance between the rotating cylinder 50 and the rotating cylinder 86 of the projector 20 is a fixed distance. In the projector 230 the distance between the rotating cylinder 50 and the rotating cylinder 86 is a variable distance.

In FIG. 17 it is seen that the projector 230 comprises a lower first half 232 of the housing and an upper first half 234 of the housing. The members 232 and 234 are equivalent to the housing 222 of projector 20. Also, the projector 230 comprises a lower second half 236 and an upper second half 238. The members 236 and 238 are equivalent to the housing 60 of the projector 20. The members 232 and 234 have a lower opening 64 and an upper opening 68. The tennis ball can enter the lower openings 30 and 64 and be rotated by the rotating cylinder 50 and the rotating cylinder 86. These two rotating cylinders can eject the tennis ball through the openings 34 and 68.

In FIG. 17 it is seen that there is a hinge 240 connecting the lower first half 232 with the upper first half 234. The hinge 240 comprises a first plate 242 on the lower first half 232 and also comprises a plate 244 on the upper first half 234. There is a hinge means 246 connecting the plates 242 and 248. The hinge 240 allows the lower first half 232 and the upper first half 234 to rotate with respect to each other.

Again, in FIG. 17 it is seen that there is a hinge 248 having a first plate 250 attached to the lower second half 236 and a second plate 252 attached to the upper second half 238. There is a hinge means 254 connecting the first plate 250 with the second plate 252. The hinge 248 allows the lower second half 236 and the upper second 238 to rotate with respect to each other.

In 236 it is seen that there is an adjusting means 256 having a mounting plate 256 comprises a threaded rod 260 connecting with the mounting plate 258.

The adjusting means 256 also comprises a mounting plate 262 connecting with the upper second half 238. There is a keeper 264 on the mounting plate 262. There is a nut 266 positioned in the keeper 264. The nut 266 receives the threaded rod 260. By rotating the nut 266 it is possible to rotate the upper second half 238 with respect to the lower second half 236 thereby varying the distance between the rotating cylinder 86 and the rotating cylinder 50.

Again, there is the motor 42 mounted on the mounting plate 44. The mounting plate 44 attaches to the lower first half 232. The motor 42 has electric lines 112 (in phantom).

Also, there is a motor 82 mounted on the mounting plate 80. The mounting plate 80 connects with the upper second half 238. The motor 82 has electric lines 112 (in phantom).

It is to be realized that the motors 42 and 82 may be other than electric motors. For example, these motors may be internal combustion engines.

There are nuts and bolts 110 for holding together the lower first half 232 and the lower second half 236 and also for holding together the upper first half 234 and the upper second half 238.

The construction of the lower first half 232 for positioning the motor 42 and the rotating cylinder 50 is the same as described for motor 42 and rotating cylinder 50 of the projector 20. Likewise, the construction for the motor 82 and the rotating cylinder 86 is the same construction as the rotating cylinder 86 of the projector 20.

The projector 230 serves the same purpose as the projector 20. With the projector 230 it is possible to vary the distance between the rotating cylinders 50 and 86 so as to vary the speed of ejection of the tennis balls from the projector 230 through the openings 34 and 68. If the rotating cylinders 50 and 86 are spaced close together and the tennis ball is squeezed between these two rotating cylinders the tennis ball will be ejected from the projector 230 with more energy and momentum as contrasted when the rotating cylinders 50 and 86 are spaced farther apart and the tennis ball is not squeezed between these two rotating cylinders. Naturally, the speed of the tennis ball and the energy of the tennis ball and the momentum of the tennis ball upon leaving the projector 230 will have considerable influence upon its flight characteristics and the distance it travels before bouncing and also the height the tennis ball will achieve before its downward flight. These varying characteristics make it possible for a person practicing tennis to have a greater variety of positions of the ball so as to be able to develop a greater variety of strokes in hitting the tennis ball, either in flight or after the tennis ball has bounced. Again, the turnbuckle 159 connects together the backstop 120 and the projector 230.

The housings 22, 60, 182 and 202 can be of metal or plastic.

The housings can be of cast aluminum or of a suitable, molded plastic. Aluminum has a low specific weight and the housings and projectors can be of light weight if made of aluminum. Generally, plastic has a low specific weight and the housings and projectors can be or light weight if made of plastic.

If the projectors are made of a plastic there can be prepared dies. Then, the housings of the projectors can be molded plastic or cast plastic. There are suitable commercial plastics such as nylon, polyethylene, polypropylene, polycarbonate and methyl methacrylate to name a few of the suitable plastics. After a die or dies have been made for the projector the making of the parts can be inexpensive. With the dies the parts for the housing can be made in large quantities at a low cost. The motors and cylinders for the projectors are commercially available.

In preparing this patent application I did not make a patent search. To the best of my knowledge there is no similar projector for ejecting tennis balls.

I consider my invention to be new as I know of no similar projector for ejecting tennis balls of such a simple, straightforward construction. There may be one or there may be two rotating curved surfaces for contacting a tennis ball and imparting energy and momentum to the tennis ball. The tennis ball is ejected from the projector and has a flight which makes it possible for a person to hit the tennis ball.

I consider my invention to be useful as a person may practice hitting the tennis ball. Many people practice tennis and like to improve their game of tennis. They may not be able to find another person with whom to practice tennis so my invention makes it possible for a person to practice the swing of the tennis racket or, my invention is a teaching aid for tennis players, for hitting the tennis ball. Many people play tennis for fun and relaxation and also as a mild form of exercise.

I consider my invention to be unobvious as I did not know of another projector of similar construction and design. In fact, I do not know of another projector having one or two rotating curved surfaces for contacting a tennis ball and ejecting a tennis ball so that the tennis ball flies through the air so that a person can hit the tennis ball.

Having presented my invention what I claim is:

1. A projector for ejecting a tennis ball, said projector comprising:

a. a housing;
b. a first recess in said housing;
c. a first opening in said housing;
d. said first opening connecting with said first recess;
e. a second opening in said housing;
f. said second opening connecting with said first recess;
g. a first rotatable curved surface in said first recess;
h. a means for rotating said first rotatable curved surface;
i. said first recess having a wall;
j. said first rotatable curved surface and said wall defining a first passageway;
k. said first opening connecting with said passageway;
l. said second opening connecting with said passageway;
m. said projector being capable of receiving said tennis ball through said first opening moving said tennis ball through said first passageway with said first rotatable curved surface in contact with said tennis ball through an angle of a least 180° as said tennis ball contacts said first rotatable curved surface and remains in contact with said first rotatable curved surface as said first rotatable curved surface rotates through at least 180°, and ejecting said tennis ball through said second opening;
n. said first recess, said first opening, said second opening, and said wall being unitary with said housing; and,
o. said housing having said first recess, said first opening, said second opening and said wall being unitary.

2. A projector for ejecting a tennis ball according to claim 1 comprising:

a. a second recess in said housing;
b. a second passageway between said first recess and said second recess;
c. a second rotatable curved surface in said second recess; and,
d. said passageway being capable of receiving a tennis ball through said first opening, moving a tennis ball through said first passageway and through said second passageway between said first rotatable curved surface in said first recess and said second rotatable curved surface in said second recess, and ejecting a tennis ball through said second opening.

3. A projector for ejecting a tennis ball according to claim 2 comprising:

a. a means for rotating said second rotatable curved surface.

4. A projector for ejecting a tennis ball according to claim 2 comprising:

a. a means to adjust the distance between said first rotatable curved surface and said second rotatable curved surface.

5. A projector for ejecting a tennis ball according to claim 2 comprising:

a. said first rotatable curved surface having a roughened surface.

6. A projector for ejecting a tennis ball according to claim 2 comprising:

a. said second rotatable curved surface having a roughened surface.

7. A projector for ejecting a tennis ball according to claim 2 comprising:

a. a means for rotating said second rotatable curved surface;
b. said first rotatable curved surface having a roughened surface; and,
c. said second rotatable curved surface having a roughened surface.

8. A projector for ejecting a tennis ball according to claim 7 comprising:

a. a means to adjust the distance between said first rotatable curved surface and said second rotatable curved surface.

9. A combination of a tennis ball and a projector for ejecting a tennis ball, said projector comprising:

a. a housing;
b. a first recess in said housing;
c. a first opening in said housing;
d. said first opening connecting with said first recess;
e. a second opening in said housing;
f. said second opening connecting with said first recess;
g. a first rotatable surface in said first recess;
h. a means for rotating said first rotatable curved surface;
i. said first recess having a wall;
j. said first rotatable curved surface and said wall defining a first passageway;
k. said first opening connecting with said passageway;
l. said second opening connecting with said passageway;
m. said projector being capable of receiving said tennis ball through said first opening moving said tennis ball through said first passageway with said first rotatable curved surface in contact with said tennis ball through an angle of at least 180° as said tennis ball contacts said first rotatable curved surface as said first rotatable curved surface rotates through at least 180° and ejecting said tennis ball through said second opening;
n. said first recess, said first opening, said second opening, and said wall being unitary with said housing; and,
o. said housing having said first recess, said first opening, said second opening and said wall being unitary.

10. A combination of a tennis ball and a projector for ejecting a tennis ball according to claim 9 comprising:

a. a second recess in said housing;
b. a second passageway between said first recess and said second recess;
c. a second rotatable curved surface in said second recess; and,
d. said passageway being capable of receiving said tennis ball through said first opening moving said tennis ball through said first passageway and through said second passageway between said first rotatable curved surface in said first recess and said second rotatable curved surface in said second recess, and ejecting said tennis ball through said second opening.

11. A combination of a tennis ball and a projector for ejecting a tennis ball according to claim 10 comprising:

a. a means for rotating said second rotatable curved surface.

12. A combination of a tennis ball and a projector for ejecting a tennis ball according to claim 10 comprising:

a. a means to adjust the distance between said first rotatable curved surface and said second rotatable curved surface.

13. A combination of a tennis ball and a projector for ejecting a tennis ball according to claim 10 comprising:

a. said first rotatable curved surface having a roughened surface.

14. A combination of a tennis ball and a projector for ejecting a tennis ball according to claim 10 comprising:

a. said second rotatable curved surface having a roughened surface.

15. A combination of a tennis ball and a projector for ejecting a tennis ball according to claim 10 comprising:

a. a means for rotating said second rotatable curved surface;
b. said first rotatable curved surface having a roughened surface; and,
c. said second rotatable curved surface having a roughened surface.

16. A combination of a tennis ball and a projector for ejecting a tennis ball according to claim 15 comprising:

a. a means to adjust the distance between said first rotatable curved surface and said second rotatable curved surface.

17. A combination of a backstop and a projector for ejecting a tennis ball:

A. said backstop comprising:
a. a means to interrupt the movement of a tennis ball;
b. a means to direct a tennis ball to a certain location;

B. said projector comprising:
a. a housing;
b. a first recess in said housing;
c. a first opening in said housing;
d. said first opening connecting with said first recess;
e. a second opening in said housing;
f. said second opening connecting with said first recess;
g. a first rotatable curved surface in said first recess;
h. a means for rotating said first rotatable curved surface;
i. said first recess having a wall;
j. said first rotatable curved surface and said wall defining a first passageway;
k. said first opening connecting with said passageway;
l. said second opening connecting with said passageway;
m. said projector being capable of receiving said tennis ball through said first passageway, moving said tennis ball through said first passageway with said first rotating curved surface in contact with said tennis ball through an angle of at least 180° as said tennis ball contacts said first rotating curved surface and remains in contact with said first rotating curved surface as said first rotating curved surface rotates through at least 180°, and ejecting said tennis ball through said second opening;
n. said first opening being juxtapositioned to said certain location to receive a tennis ball from said backstop to permit said projector to eject said tennis ball;
o. said first recess, said first opening, said second opening, and said wall being unitary with said housing; and,
p. said housing having said first recess, said first opening, said second opening and said wall being unitary.

18. A combination of a backstop and a projector for ejecting a tennis ball according to claim 17 comprising:

a. a second recess in said housing;
b. a second passageway between said first recess and said second recess;

c. a second rotatable curved surface in said second recess; and, d. said passageway being capable of receiving said tennis ball through said first opening, moving said tennis ball through said first passageway and through said second passageway between said first rotatable curved surface in said first recess and said second rotatable curved surface in said second recess, and ejecting said tennis ball through said second opening.

19. A combination of a backstop and a projector for ejecting a tennis ball according to claim 18 comprising:

a. a means for rotating said second rotatable curved surface.

20. A projector for ejecting a tennis ball, said projector comprising:

a. a housing;

b. a first recess in said housing;

c. a first opening in said housing;

d. said first opening connecting with said first recess;

e. a second opening in said housing;

f. said second opening connecting with said first recess;

g. a first rotatable curved surface in said first recess;

h. a means for rotating said first rotatable curved surface;

i. said first recess having a wall;

j. said first rotatable curved surface and said wall defining said first passageway;

k. said first opening connecting with said passageway;

l. said second opening connecting with said passageway;

m. said projector being capable of receiving said tennis ball through said first opening moving said tennis ball through said first passageway and ejecting said tennis ball through said second opening;

n. a second recess in said housing;

o. a second passageway between said first recess and said second recess;

p. a second rotatable curved surface in said second recess;

q. said first passageway being capable of receiving said tennis ball through said first opening, moving said tennis ball through said first passageway and through said second passageway between said first rotatable curved surface in said first recess and said second rotatable curved surface in said second recess, and ejecting said tennis ball through said second opening; and, r. said first recess, said first opening, said second opening, said wall, and said second recess being unitary with said housing.

21. A projector for ejecting a tennis ball according to claim 20 and comprising:

a. a means for rotating said second rotatable curved surface.

22. A projector for ejecting a tennis ball according to claim 20 and comprising:

a. a means to adjust the distance between said first rotatable curved surface and said second rotatable curved surface.

23. A projector for ejecting a tennis ball according to claim 20 and comprising:

a. said first rotatable curved surface having a roughened surface.

24. A projector for ejecting a tennis ball according to claim 20 and comprising:

a. said second rotatable curved surface having a roughened surface.

25. A projector for ejecting a tennis ball according to claim 21 and comprising:

a. a means for rotating said second rotatable curved surface;

b. said first rotatable curved surface having a roughened surface; and c. said second rotatable curved surface having a roughened surface.

26. A projector for ejecting a tennis ball according to claim 25 and comprising:

a. a means to adjust the distance between said first rotatable curved surface and said second rotatable curved surface.

27. A combination of a tennis ball and a projector for ejecting a tennis ball, said projector comprising:

a. a housing;

b. a first recess in said housing;

c. a first opening in said housing;

d. said first opening connecting with said first recess;

e. a second opening in said housing;

f. said second opening connecting with said first recess;

g. a first rotatable curved surface in said first recess;

h. a means for rotating said first rotatable curved surface;

i. said first recess having a wall;

j. said first rotatable curved surface and said wall defining a first passageway;

k. said first opening connecting with said passageway;

l. said second opening connecting with said passageway;

m. said projector being capable of receiving said tennis ball through said first opening moving said tennis ball through said first passageway and ejecting said tennis ball through said second opening;

n. a second recess in said housing;

o. a second passageway between said first recess and said second recess;

p. a second rotatable curved surface in said second recess;

q. said passageway being capable of receiving said tennis ball through said first opening moving said tennis ball through said first passageway and through said second passageway between said first rotatable curved surface in said first recess and said second rotatable curved surface in said second recess, and ejecting said tennis ball through said second opening; and, r. said first recess, said first opening, said second opening, said wall, and said second recess being unitary with said housing.

28. A combination of a tennis ball and a projector for ejecting a tennis ball according to claim 27 comprising:

a. a means for rotating said second rotatable curved surface.

29. A combination of a tennis ball and a projector for ejecting a tennis ball according to claim 27 comprising:

a. a means to adjust the distance between said first rotatable curved surface and said second rotatable curved surface.

30. A combination of a tennis ball and a projector for ejecting a tennis ball according to claim 27 comprising:

a. said first rotatable curved surface having a roughened surface.

31. A combination of a tennis ball and a projector for ejecting a tennis ball according to claim 27 comprising:
a. said second rotatable curved surface having a roughened surface.

32. A combination of a tennis ball and a projector for ejecting a tennis ball according to claim 27 comprising:
a. a means for rotating said second rotatable curved surface;
b. said first rotatable curved surface having a roughened surface; and,
c. said second rotatable curved surface having a roughened surface.

33. A combination of a tennis ball and a projector for ejecting a tennis ball according to claim 32 comprising:
a. a means to adjust the distance between said first rotatable curved surface and said second rotatable curved surface.

34. A combination of a backstop and a projector for ejecting a tennis ball:
A. said backstop comprising:
a. a means to interrupt the movement of a tennis ball;
b. a means to direct a tennis ball to a certain location;
B. said projector comprising:
a. a housing;
b. a first recess in said housing;
c. a first opening in said housing;
d. said first opening connecting with said first recess;
e. a second opening in said housing;
f. said second opening connecting with said first recess;
g. a first rotatable curved surface in said first recess;
h. a means for rotating said first rotatable curved surface;
i. said first recess having a wall;
j. said first rotatable curved surface and said wall defining a first passageway;
k. said first opening connecting with said passageway;
l. said second opening connecting with said passageway;
m. said projector being capable of receiving said tennis ball through said first passageway and ejecting said tennis ball through said second opening;
n. said first opening being juxtapositioned to said certain location to receive a tennis ball from said backstop to permit said projector to eject said tennis ball;
o. a second recess in said housing;
p. a second passageway between said first recess and said second recess;
q. a second rotatable curved surface in said second recess
r. said passageway being capable of receiving said tennis ball through said first opening, moving said tennis ball through said first passageway and through said second passageway between said first rotatable curved surface in said first recess, and ejecting said tennis ball through said second opening; and,
s. said first recess, said first opening, said second opening, said wall, and said second recess being unitary with said housing.

35. A combination of a backstop and a projector for ejecting a tennis ball according to claim 34 comprising:
a. a means for rotating said second rotatable curved surface.

36. A combination of a backstop and a projector for ejecting a tennis ball:
A. said backstop comprising:
a. a means to interrupt the movement of a tennis ball;
b. a means to direct a tennis ball to a certain location;
c. said means to interrupt the movement of said tennis ball comprising a back panel, two side panels, a top panel, a front panel and a bottom panel sloping to direct a tennis ball in said certain location; and,
d. said front panel in conjunction with said top panel defining an opening through which said tennis ball may pass.
B. said projector comprising:
a. a housing;
b. a first recess in said housing;
c. a first opening in said housing;
d. said first opening connecting with said first recess;
e. a second opening in said housing;
f. said second opening connecting with said first recess;
g. a first rotatable curved surface in said first recess;
h. a means for rotating said first rotatable curved surface;
i. said first recess having a wall;
j. said first rotatable curved surface and said wall defining a first passageway;
k. said first opening connecting with said passageway;
l. said second opening connecting with said passageway;
m. said projector being capable of receiving said tennis ball through said first passageway, moving said tennis ball through said first passageway with said first rotating curved surface in contact with said tennis ball through an angle of at least 180° as said tennis ball contacts said first rotating curved surface and remains in contact with said first rotating curved surface as said first rotating curved surface rotates through at least 180°, and ejecting said tennis ball through said second opening;
n. said first opening being juxtapositioned to said certain location to receive a tennis ball from said backstop to permit said projector to eject said tennis ball;
o. said first recess, said first opening, said second opening and said wall being unitary with said housing; and,
p. said housing having said first recess, said first opening, said second opening and said wall being unitary.

* * * * *